United States Patent [19]

Block

[11] 4,236,269

[45] Dec. 2, 1980

[54] VERTICAL AXIS BRUSH

[75] Inventor: Thomas S. Block, Muskegon, Mich.

[73] Assignee: Clarke-Gravely Corporation, Muskegon, Mich.

[21] Appl. No.: 35,393

[22] Filed: May 2, 1979

[51] Int. Cl.[3] ..... A46B 13/02

[52] U.S. Cl. ..... 15/180; 15/202

[58] Field of Search ..... 15/180, 182, 196, 197, 15/198, 200, 168, 169, 49 R, 50 R, 52, 176, 202, 230, 199

[56] References Cited

U.S. PATENT DOCUMENTS

| | | | |
|---|---|---|---|
| 1,958,658 | 5/1934 | Engberg | 15/180 |
| 2,242,577 | 5/1941 | Finnell | 15/180 |
| 2,605,490 | 8/1952 | Dolan | 15/180 |
| 2,753,580 | 7/1956 | Lombardi | 15/202 |
| 2,790,640 | 4/1957 | Hoag | 15/202 X |
| 3,233,272 | 2/1966 | Pambello | 15/182 |
| 3,243,832 | 4/1966 | Allon | 15/180 |
| 3,501,798 | 3/1970 | Carraro | 15/180 X |
| 3,562,843 | 2/1971 | Belicka | 15/180 |
| 3,678,530 | 7/1972 | Horton | 15/180 |
| 3,875,607 | 4/1975 | Rosseau | 15/180 |

FOREIGN PATENT DOCUMENTS

| | | | |
|---|---|---|---|
| 456984 | 3/1928 | Fed. Rep. of Germany | 15/180 |
| 2225561 | 5/1972 | Fed. Rep. of Germany | 15/180 |
| 808944 | 1/1966 | France | 15/180 |
| 190326 | 6/1928 | U.S.S.R. | 15/180 |
| 388731 | 7/1930 | U.S.S.R. | 15/180 |
| 456606 | 9/1942 | U.S.S.R. | 15/180 |

*Primary Examiner*—Edward J. McCarthy

*Attorney, Agent, or Firm*—Price, Heneveld, Huizenga & Cooper

[57] ABSTRACT

A vertical axis brush for use with a rotary floor maintenance apparatus is disclosed. The brush includes a holder plate having an integral peripherally extending and depending skirt to which are detachably secured a plurality of brush segments. Each brush segment is generally U-shaped in plan and is held to the holder plate by a pair of opposed clamps which define a channel. The clamps are integral with the plate and radially receive the brush members in a detachable snap fit fashion. When mounted, each of the brush members is engaged by the clamps and also engaged by the depending skirt of the holder plate.

25 Claims, 5 Drawing Figures

VERTICAL AXIS BRUSH

BACKGROUND OF THE INVENTION

The present invention relates to floor maintenance apparatus and more particularly to a vertical axis rotary floor treating element for such apparatus.

A fairly wide variety of floor maintenance machines are presently available. Such machines are used for scrubbing, stripping, polishing or buffing a floor surface. A rotary floor treating element engages the floor surface and is rotated about its vertical axis typically by an electric motor through a drive transmission. The machine may be supported on the floor surface by wheels and the floor treating element is rotated to strip, polish or buff the floor surface.

Rotary floor scrubbing machines may include one or more rotary floor treating elements which take the form of brushes. Water and a cleaning compound may be fed to the brushes which mix the solution and scrub the floor. Such machines are moved along the floor and after the scrubbing operation is completed, the water is removed from the floor with suction devices.

The scrubbing brushes are, of course, subject to wear during use. In commercial applications, the brushes must be replaced at fairly frequent intervals. Heretofore, such replacement has been a fairly time consuming, difficult and/or expensive proposition.

Various attempts have been made to reduce the difficulty and expense involved in replacing the brushes of the scrubbing machines. The brushes typically include a holder plate to which the brush elements are secured. The brush elements may be arranged circumferentially of the plate in radially spaced rows or they may be arranged as segments extending radially from the central axis of the plate. Typically, the brush elements are secured to the plate by fasteners such as bolts. Employing fasteners increases the time necessary to replace the brushes as well as the difficulty of maintenance. When brush replacement is difficult and/or time consuming, the required brush maintenance may not be performed and a satisfactory scrubbing operation will not be obtained.

Various attempts have been made to increase the ease of and reduce the expense of brush replacement. For example, U.S. Pat. No. 2,242,577, entitled FLOOR SCRUBBING APPARATUS and issued on May 20, 1941 to Finnell discloses a floor scrubbing apparatus including a generally circular brush holder plate or disc. Secured to the plate by fasteners are a plurality of individual scrub brush units. Each unit includes a brush holder in the form of a channel. One sidewall of the channel includes a plurality of inwardly extending prongs. The opposite wall supports a bowed leaf spring. Individual brushes or segments have bristles extending from a wooden brush back. The brush back is tilted so as to engage the leaf spring which is pushed to permit clearance for the brush back which is then rotated between the walls of the channel. The leaf spring then causes the prongs to bite into or engage the brush back.

Another example of a rotary brush may be found in U.S. Pat. No. 3,678,530, entitled ROTARY BRUSH PLASTIC BRISTLE HOLDER AND MOUNTING MEANS and issued on July 25, 1972 to Horton et al. This patent is primarily related to a gutter broom of the type used on road sweeping machines and discloses an assembly including a circular steel plate. A plurality of paired inverted T-shaped bars are mounted radially on one face of the plate. Brush bristles are carried by bristle holders and the holders are slipped between the T-shaped bars. A retaining collar is positioned to encircle the holders and the inverted T-shaped bars in order to wedge the holders in place. The retaining collar is secured to the plate by bolts and removal of the collar is necessary for replacement of the individual brush segments.

A need exists for a vertical axis brush whereby the costs of manufacture are reduced when compared to present structures and the ease of brush replacement is increased, as well as the ease of manufacture and assembly.

SUMMARY OF THE INVENTION

In accordance with the present invention, a unique, relatively inexpensive and easily manufactured segmented vertical axis brush is provided whereby the individual brush segments or elements are easily and readily replaced without the use of hand tools. Essentially, the brush includes a holder plate and a plurality of brush members or segments, each including a base element and a plurality of bristles held by the base element. Mounting means are provided on the brush holder plate for radially receiving and detachably yet positively mounting each of the brush segments to the plate in a snap fit fashion. The brush segments may be mounted to and removed from the holder plate without the use of tools.

DETAILED DESCRIPTION OF THE PREFERRED EMBODIMENT

Figure 1:
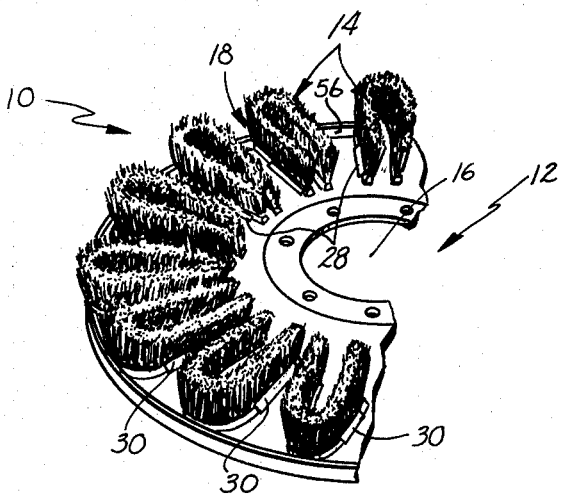
FIG. 1 is a fragmentary view of a segmented, vertical axis brush in accordance with the present invention.

A floor treating element or scrubber brush in accordance with the present invention is illustrated in FIG. 1 and generally designated 10. Scrubber brush 10 is primarily adapted for use with a floor treating machine of the type which dispenses a liquid cleaning solution which in turn is scrubbed into a floor surface by the brush 10. The brush is positioned on a machine in a generally horizontal plane and rotated about its vertical axis. Brush 10 includes a brush holder plate 12 and a plurality of brush segments or brush elements 14. Each brush segment 14 is secured to brush holder plate 12 so as to extend generally radially from a central axis or center point 16. Each brush element is detachably held on the plate 12 by mounting or retaining means generally designated 18.

Figure 2:
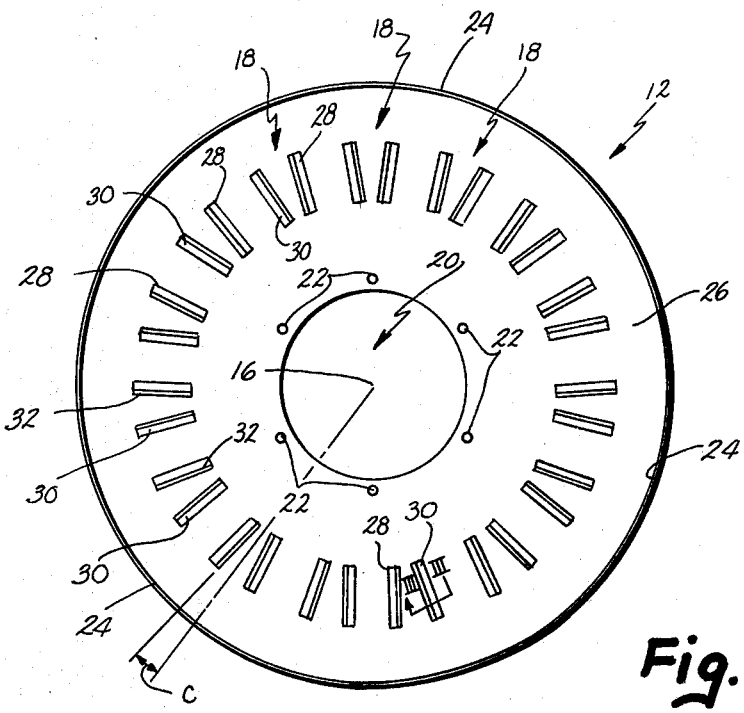
FIG. 2 is a bottom plan view of a brush holder plate in accordance with the present invention.
Figure 3:
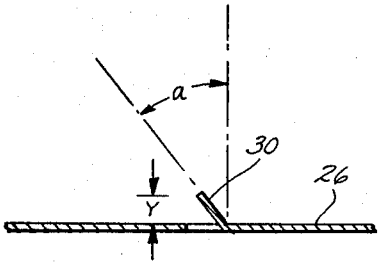
FIG. 3 is a cross-sectional view taken generally along line III—III of FIG. 2.

As best seen in FIG. 2, brush holder plate 12 is generally circular in plan and includes a central circular aperture 20. A plurality of bolt apertures 22 are equally positioned circumferentially around aperture 20. Plate 12 is secured to a floor treating machine in a conventional fashion at the aperture 20 and bolt apertures 22. Plate 12 in the preferred embodiment is formed with an integral, depending peripherally extending skirt 24. As explained in detail below, skirt 24 assists in retaining the individual brush elements or segments 14 on plate 12. Skirt 24 extends around the entire circumferential outer periphery of the brush holder plate. Positioned on the undersurface 26 of the plate 12 are the brush segment mounting or retaining means 18. The retaining means 18 are arranged in a circular pattern intermediate the central axis 16 and plate skirt 24. Retaining means 18 are circumferentially equally spaced around the central axis 16. Each means 14 includes a pair of resilient clamps or down struck flanges 28, 30. In the preferred embodiment, each flange 28, 30 is formed integral with the plate 26. Plate 26 during the manufacturing process is lanced and slit along a generally U-shaped line 32. The lanced portions of the plate are then bent downwardly or down struck to define the integral flanges which overly apertures in the plate. This is best seen in FIG. 3. Each clamp 28, 30 extends at an acute angle designated "a" in FIG. 3 from a vertical line. Flanges 28, 30 open towards each other so as to define with the base a channel open at both ends for receipt of a brush element, as described in detail below. Flanges 28, 30 converge towards each other in a radially inward direction from the skirt 24 towards the center 16. As seen in FIG. 2, each flange is angled with respect to a radial line extending outwardly from the central axis. The positioning of flanges 28, 30 is symmetrical about the radial line. In a presently existing embodiment, the angle "a" from vertical of each flange 28, 30 is 37°. Each flange has an angle of conversion designated "c" in FIG. 2 of 10°.

Brush plate holder 12 in accordance with the present invention is easily and relatively inexpensively manufactured. The holder is preferably fabricated from a sheet metal material such as cold rolled steel. Skirt 24 is easily formed integrally during a stamping operation at which time the central aperture 20 may be formed. Simple lancing techniques are employed to form the retaining means 18 integral with brush plate holder 12. No separate fasteners are necessary to secure the brush retaining means to the plate.

Figure 4:
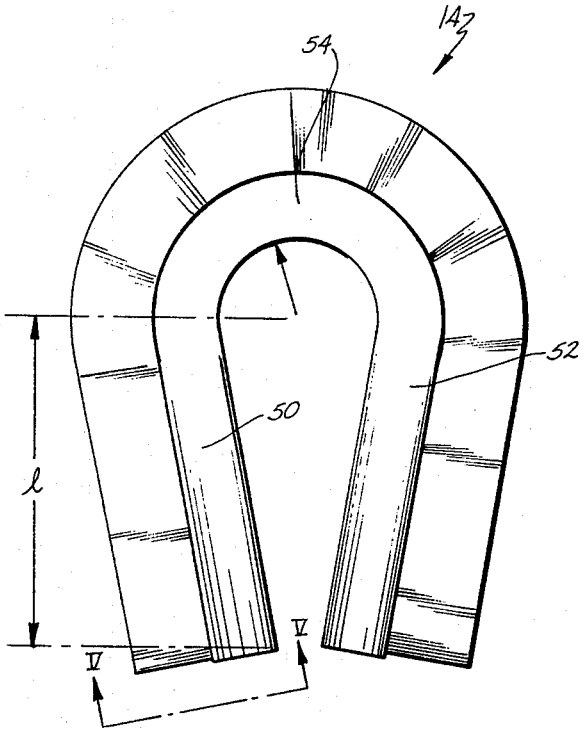
FIG. 4 is a bottom, plan view of a brush segment or element in accordance with the present invention.
Figure 5:
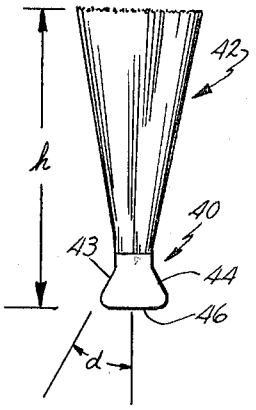
FIG. 5 is an end, elevational view taken generally along line V—V of FIG. 4.

As best seen in FIGS. 1, 4 and 5, each brush segment 18 is generally U-shaped in plan and includes a strip-like base element 40 which carries a plurality of bristles 42. Base element 40 is dovetail shaped in vertical section, as best seen in FIG. 5, and includes converging sidewalls 43, 44 and a bottom wall 46. Base element 40 is tightly crimped against the lower ends of the bristles 43 so as to form a single unit. Base strip 40 in the preferred embodiment has a generally horseshoe shape in plan and includes leg portions 50, 52 and a rounded base or joining portion 54. In a presently existing embodiment, walls 43, 44 have an angle of convergence designated "d" in FIG. 5 of 37°.

The configuration of each brush element 14 permits them to be easily mounted on brush plate holder 12. Each brush segment is radially slipped within the channel defined by the opposed converging clamps 28, 30 in a detachable yet positive fashion. As seen in FIG. 1, each element 14 has the free ends of leg portions 50, 52 slipped initially between the outer ends of flanges 28, 30. The spacing of the retaining means 18 from the skirt 24 permits the brush element to be pushed radially inwardly towards the central axis 16 until it snaps over the edge of skirt 24. When in position, clamps 28, 30 will resiliently clamp down on sidewall 43 of base strip or base element 40 of each brush element and the nose or base portion 54 of each element will engage the inner surface 56 of depending skirt 24. As a result, each brush element is rigidly and positively held at three engagement areas. The configuration and dimensioning of each brush segment 14 and the clamps 28, 30 insures that resilient clamping action securely retains the brushes on the holder 12. Each brush is, therefore, held without fasteners and may be mounted and dismounted without the use of hand tools. This represents a significant advance over the prior proposals which have generally required use of hand tools or some form of fastener to retain brush elements on a brush holder plate. Further, the clamping or retaining means 18 are formed integral with the plate and no fasteners are necessary to secure the retaining means to the plate in the preferred embodiment. The segmented vertical axis brush, in accordance with the present invention, besides representing a reduction in the cost of manufacture also promotes proper maintenance of the brush since replacement of worn brush elements or segments is a simple matter for the operator. Further, the same size segment may be used with different sizes of holder plates.

In the presently existing embodiment, the brush plate has a diameter at the inner surface 56 of skirt 24 of 410 mm. The outer diameter of the circle defined by the retaining means 18 is 330 mm. As a result, the clamps of each retainer are spaced a radial distance of 40 mm. from the inner surface of skirt 24. Base strip 40 of each brush segment has a transverse width of 15.24 mm. and the radius of the base portion 54, designated R in FIG. 4, is 14 mm. The distance L in FIG. 4 from the axis of radius R to an innermost corner of leg portion 50 is 80 mm. The overall vertical height of the brush segment, designated H in FIG. 5, is 45 mm. Each clamp 28 has a length dimension of 38 mm. and a down struck distance, designated Y in FIG. 3, of 9 mm. A total of 15 retaining means 18 are equally spaced on the plate. Plate 12 is preferably fabricated from cold rolled steel and has a 2 mm. thickness. Base strip 40 of brush segment 14 is fabricated from steel and is crimped on the bristles.

In view of the foregoing description, it should be readily appreciated that the present invention possesses significant advantages over prior rotary floor treating elements in that each brush segment is easily installed and removed without the use of hand tools. The radial inward direction of insertion of the brush segments between clamps 28, 30 also increases the ease of maintenance since the segments may be replaced while the brush holder plate 12 is still installed on the machine. There is no need to remove the plate and turn it upside down for replacement of brush segments.

Also in view of the foregoing description, those of ordinary skill in the art will undoubtedly envision various modifications to the present invention which would not depart from the inventive concepts disclosed herein. For example, other floor treating members besides scrub brushes could be similarly configured and mounted on the holder plate. Also, clamps 28, 30 could be fabricated as separate elements and subsequently secured to the base plate. The full benefits of the present invention would not, however, be obtained. Therefore, it is expressly intended that the above description should be considered as that of the preferred embodiment. The true spirit and scope of the present invention may be determined by reference to the appended claims.

The embodiments of the invention in which an exclusive property or privilege is claimed are defined as follows:

1. A segmented vertical axis brush for use with a floor treating machine, said brush comprising:

a brush holder plate having an integral peripherally extending, depending skirt, said plate further having a central, rotary axis;

a plurality of brush members, each brush member including a base element and a plurality of bristles held by said base element; and mounting means circumferentially spaced around said central axis and on said brush holder plate and extending downwardly therefrom for radially receiving and detachably yet positively mounting said brush members to said plate in a snap fit fashion, each of said brush members when mounted, engaging an inner peripheral surface of said skirt and extending radially outwardly from said central rotary axis of said brush holder plate whereby said brush members may be mounted and removed from said plate without the use of tools.

2. A segmented vertical axis brush as defined by claim 1 wherein said mounting means comprises a plurality of paired resilient clamps, each pair of clamps engaging one of said brush members.

3. A segmented vertical axis brush as defined by claim 2 wherein said resilient clamps are integral with said brush plate holder and are formed by lancing said plate and bending the lanced portions of said plate, said clamps thereby overlying apertures formed in said plate, each clamp of a pair of clamps opening from said plate towards one another to define a channel for receipt of a base element of a brush element.

4. A segmented vertical axis brush as defined by claim 1 wherein each of said brush members is generally U-shaped in plan, said base element having a pair of leg portions joined by a base portion, said base portion of said base element engaging said skirt and said mounting means engaging said brush member along a portion of each of said leg portions of said base element to clamp said base element to said brush holder plate.

5. A segmented vertical axis brush as defined by claim 4 wherein said leg portions of each of said base elements converge towards each other.

6. A segmented vertical axis brush as defined by claim 4 wherein said mounting means comprises a plurality of paired resilient clamps, each clamp of a pair of clamps engaging and clamping a leg portion of each of said base elements to said brush holder plate.

7. A segmented vertical axis brush as defined by claim 6 wherein each pair of resilient clamps defines a dovetail shaped channel in cross section and said leg portions of each of said base elements include a correspondingly configured side engaged by one of said clamps.

8. A segmented vertical axis brush as defined by claim 7 wherein each of said clamps are integral with said brush holder plate and are formed by lancing said plate and bending the lanced portions of said plate, said clamps each overlying apertures formed in said plates and said clamps of each pair of clamps opening towards each other to define said dovetail shaped channel.

9. A segmented vertical axis brush as defined by claim 8 wherein said brush holder plate is generally circular in plan and has a vertical axis defining said central, rotary axis, said clamps converging towards one another and towards a line extending radially from the central axis of said brush holder plate and said pairs of clamps being equally spaced circumferentially of said brush holder plate.

10. A segmented vertical axis brush as defined by claim 9 wherein said leg portions of each of said brush elements converge towards one another so that said brush members are generally horseshoe shaped in plan, each clamp of a pair of clamps engaging a portion of the leg portion of each of said base elements.

11. A vertical axis floor treating member of the type including a plurality of floor engaging elements, said member comprising:

a generally circular plate having a central aperture;

a plurality of floor engaging elements, each of said elements including an elongated strip-like member configured to a generally U-shape in plan thereby having leg portions and a base portion;

a plurality of retaining means on said plate for radially receiving and detachably retaining in a snap fit fashion each of said floor engaging elements on said plate, said leg portions of each of said strip-like members being engaged by one of said retaining means so that said elements extend radially from said central aperture and are circumferentially spaced around said aperture; and peripheral means extending around said plate and having a surface engaging and radially retaining said floor engaging elements.

12. A vertical axis floor treating member as defined by claim 11 wherein said peripheral means comprises said circular plate further including a depending, integral, peripheral skirt.

13. A vertical axis floor treating member as defined by claim 12 wherein each of said retaining means positions one of said floor engaging elements so that the strip-like members opens towards said aperture and the base portion thereof engages the skirt.

14. A vertical axis floor treating member as defined by claim 13 wherein each of said strip-like members holds a plurality of bristles.

15. A vertical axis floor treating member as defined by claim 13 wherein each of said retaining means comprises a pair of opposed clamps, said clamps extending from said base at an acute angle from vertical and towards each other to define a channel for receipt of said floor engaging elements.

16. A vertical axis floor treating member as defined by claim 15 wherein each of said clamps converges in a radially inward direction towards a line extending radially from said central aperture.

17. A vertical axis floor treating member as defined by claim 16 wherein said clamps are integral with said plate and are formed by lancing said plate and bending lanced portions of the plate downwardly.

18. A vertical axis floor treating member as defined by claim 17 wherein each of said strip-like members is generally dovetail shaped in vertical section and said leg portions slip into the channel defined by said clamps in a tongue and groove fashion.

19. A brush holder for holding a plurality of brush members and which is usable in a rotary floor treating machine, said brush holder comprising:

a plate having an integral, depending, peripheral skirt and a center axis; and a plurality of mounting means on said plate for radially receiving and mounting a plurality of floor treating brushes to the plate in cooperation with said skirt and in a detachable, snap fit fashion, each of said mounting means comprising a pair of circumferentially spaced, resilient clamp members extending in opposed relationship from a point spaced radially inwardly from said skirt and towards a center axis of said plate.

20. A brush holder as defined by claim 19 wherein said plate is circular in plan and each of said clamp members of each of said mounting means converges towards each other and towards a line extending radially outwardly from the center axis of said plate, said clamp members each being generally planar and extending from said plate at an acute angle from vertical to define with said plate a generally dovetail shaped channel having converging sides.

21. A brush holder as defined by claim 20 wherein said clamp members are integral with said plate.

22. A brush holder as defined by claim 21 wherein said clamp members are lanced and bent portions of said plate, said clamp members thereby overlying apertures formed in said plate.

23. A brush holder as defined by claim 22 wherein said retaining means are arranged in a circular pattern intermediate the central axis and the skirt of said plate.

24. A scrub brush adapted to be mounted on a holder plate in a snap fit, detachable fashion, the holder plate having a retainer means for retaining the brush to the plate which includes a pair of opposed resilient clamp members which define a channel for receipt of the brush and wherein the plate further includes a depending, peripheral skirt, said scrub brush comprising:

an elongated base having a generally U-shape in plan thereby including leg portions joined by a base portion, said leg portions converging towards each other; and a plurality of bristles held by said base.

25. A scrub brush as defined by claim 24 wherein said base is generally dovetail shaped in section including converging sides and a flat bottom.

* * * * *